United States Patent [19]

Montgomery et al.

[11] Patent Number: 4,682,700

[45] Date of Patent: Jul. 28, 1987

[54] SAFETY CLOSURE AND CONTAINER PACKAGE

[75] Inventors: Gary Montgomery; Gene Hawkins, both of Evansville, Ind.

[73] Assignee: Sunbeam Plastics Corporation, Evansville, Ind.

[21] Appl. No.: 898,908

[22] Filed: Aug. 21, 1986

[51] Int. Cl.[4] ..... B65D 55/02

[52] U.S. Cl. ..... 215/216; 215/217; 215/224; 215/330

[58] Field of Search ..... 215/217, 218, 216, 224, 215/330

[56] References Cited

U.S. PATENT DOCUMENTS

| | | | |
|---|---|---|---|
| 3,986,626 | 10/1976 | Montgomery | 215/216 |
| 4,335,824 | 6/1982 | Bush | 215/224 |
| 4,579,239 | 4/1986 | Hart | 215/224 |

*Primary Examiner*—George T. Hall
*Attorney, Agent, or Firm*—Irvin L. Groh

[57] ABSTRACT

A safety closure and container package including an internally threaded closure cap and a container having a threaded neck. A retention flange is located on the container neck below the threads, having a gradually sloping upper surface and an abrupt, inwardly directed lower surface extending downwardly toward the neck at 45°-90°. A coacting inwardly projecting retention bead on the cap completes this child-resistant feature requiring considerably more force for removal of the closure than application. The safety package can also include a second container flange and cap bead located between the retention flange and bead and the threads to provide a non-backoff feature. The non-backoff flange has a gradually sloping upper surface and a gradually sloping inwardly directed surface extending downwardly toward the container neck at 15°-25°. The coacting inwardly projecting non-backoff bead on the cap will retain the cap in sealing contact with the container neck even during initial unthreading to provide a second safety feature. These safety features can be applied to a standard threaded package or to a dispensing package in which the closure includes a threaded cap having a dispensing orifice in its top and a lid hinged to the cap for closing of the orifice.

7 Claims, 3 Drawing Figures

SAFETY CLOSURE AND CONTAINER PACKAGE

This invention relates to a safety closure and container package, and, more particularly, to a threaded child-resistant closure and container package.

There area wide variety of safety closure and container package which have as a primary safety feature a child-resistant component which usually requires two sequential or simultaneous motions for opening or removing the closure from the container. While these packages may serve their primary function of preventing a child from opening the package, they can be equally frustrating to an adult, requiring unusual dexterity or aggravating resort to reading opening instructions.

It is, therefore, a primary objective of this invention to provide a standard threaded package with a child-resistant feature which does not require sequential or simultaneous motions for opening.

It is another object of this invention to provide a child-resistant package which is usable as a standard threaded package or a dispensing type of package.

It is still another object of this invention to provide a child-resistant safety package which includes another safety feature in the form of a non-backoff type of closure seal which retains the closure cap in sealing relationship to the container under conditions which would otherwise cause loosening of the threaded cap and consequent disturbance of the sealed condition.

The foregoing objects and other advantages of this invention are accomplished in a package including an internally threaded closure cap and a container having a threaded neck. An outwardly extending retention flange is located on the container neck below the threads, having a gradually upwardly and inwardly directed surface extending from an apex into the container neck and an abrupt inwardly directed lower surface extending downwardly from this apex at an angle of 45°–90° toward the neck. The closure cap has an annular skirt with complementary threads for engaging the container neck threads and an inwardly projecting retention bead below the threads having a minimum diameter less than the container flange apex diameter. As the cap is threaded onto the container neck, the cap retention bead is gradually expanded as its rounded surfaces moves axially downward along the upper flange surface so that the smaller diameter bead snaps over the larger diameter flange apex. Upon retrograde rotation of the cap in an opening direction, the bead coacts with the lower flange surface to resist removal. The greater force required for removal than that required for application of a cap, provides the child-resistant feature. Preferrably, the lower retention flange surface extends inwardly toward the container neck at approximately 90° thereto, providing a consistent additional torque removal requirement for removal with an easily molded surface configuration.

The threaded package normally contains sealing means coacting between the closure cap and the container which acts independently of the child-resistant feature. This can take the form of a gasket which acts between the top of the cap and the container lip, the gasket being compressed into sealing relationship after the cap retention bead snaps over the container flange apex by the continuing rotation of the cap in a closing direction.

The foregoing child-resistant package can be provided with an additional safety feature in the form of a non-backoff sealing connection between the container and the cap. This takes the form of a non-backoff flange on the container neck which is located between the threads and the retention flange. The non-backoff flange has an upper frusto-conical surface extending upwardly and inwardly from a maximum diameter plane toward the neck and a lower frusto-conical surface extending inwardly and downwardly from the maximum diameter plane at a gradual angle which is less than 30 to the neck. The cap skirt includes an inwardly projecting non-backoff bead located between the threads and the retention bead having a minimum diameter less than the maximum diameter of a non-backoff container flange so that as the cap is threaded onto the container, the non-backoff bead is gradually expanded as it moves axially downward along the upper frusto-conical surface until it snaps over the larger non-backoff flange diameter and remains in contact with the lower frusto-conical surface as the cap is tightened and as the cap is rotated in a retrograde opening direction. This keeps the cap pulled downwardly into sealing contact with the container neck until the non-backoff bead snaps back over the maximum non-backoff flange diameter. An additional sealing element is usually provided and can take the form of the previously mentioned gasket which is compressed between the cap top and the container lip, and which compression is maintained by the non-backoff connection.

Other forms of seals can be used with the child-resistant package whether or not it is provided with the additional non-backoff feature. One, such sealing connection, commonly known as a "crab-claw" seal, can be provided by a flexible annular flange depending downwardly from the cap to form an annular sealing fin for contact with the container lip.

With a closure package utilizing both the child-resistant retention flange and bead and the non-backoff flange and bead, it is immaterial whether the retention bead snaps over the retention flange first or the non-backoff bead snaps over the non-backoff flange first as the cap is threaded onto the container. Coaction between the retention flange and bead tends to cease as soon as the bead snaps over the flange, whereas coaction between the non-backoff bead and the lower frusto-conical surface of the non-backoff flange is maintained with subsequent additional threading on and during retrograde opening rotation to maintain the cap in sealing relationship to the container.

The preferred embodiments of the invention are illustrated in the drawing in:

Figure 1:
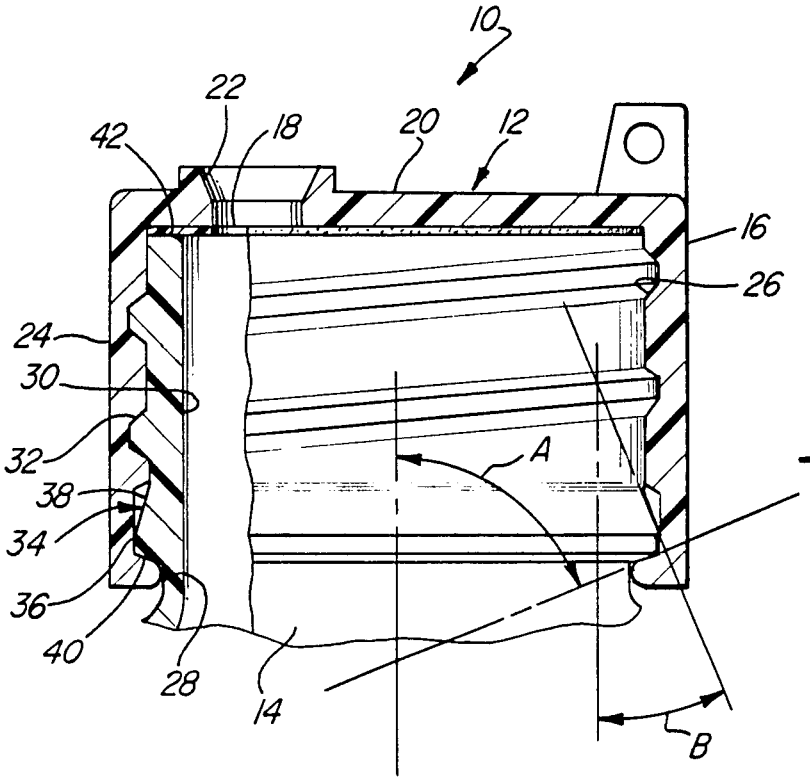
FIG. 1 is an elevational view in section showing the container and closure of the instant invention in sealing relationship with the child-resistant cap bead snapped over the container retention flange.

Referring to FIG. 1 threaded safety closure and container package 10 is shown as including closure 12 and container 14. Closure 12 includes cylindrical cap 16 and gasket 18. Cylindrical cap 16 is shown as a dispensing cap having a flat top 20 containing a dispensing orifice 22 and a depending cylindrical or slightly conical skirt 24 having internal threads 26 and inwardly projecting bead 28 is located at the bottom of skirt 24 and is a conventional rounded configuration.

Container 14 has the neck 30 formed with external threads 32 at its upper end and an outwardly projecting retention flange 34 having a maximum diameter or apex 36 located on the neck above the threads. Retention flange 34 has a gradual upwardly and inwardly directed upper surface 38 extending from apex 36 into neck 30. An abrupt, inwardly directed lower surface of retention flange 34 extends downwardly from apex 36 at an angle of 45° to 90° toward neck 30. This lower surface abrupt angle of 45° to 90° is shown as angle A between the surface and the neck or axis of the cap. The gradual upper surface 38 of flange 34 is shown as lying at an angle B with respect to the neck and cap axis. Preferably angle B is between 25° and 40° in order to keep the axial length of the upper surface short and still maintain a gradual slope.

Figure 2:
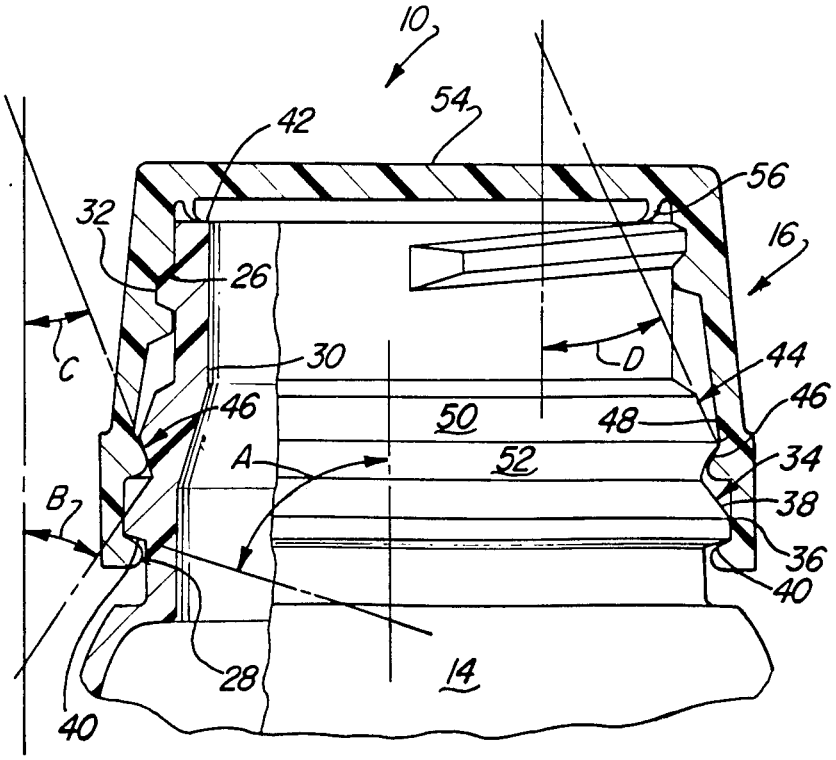
FIG. 2 is a partial elevational view in section showing a portion of the child-resistant cap bead snapped over the container retention flange with the angle of the lower flange surface being 90 to the containing neck.

As cap 16 is threaded onto container neck 30, retention bead 28 slips axially downward on upper flange surface 38 and is gradually expanded as it approaches flange flange apex. Continuing rotation of cap 16 in a tightening direction wil compress gasket 18 between cap top 20 and lip 42 at the end of container neck 30. When cap 16 is rotated in a retrograde direction for removal, cap retention bead 28 is forced against the abrupt lower flange surface 40 which resists removal. The turning force, or more correctly the turning torque, must be increased to approximately 15 lb-in. in order to stretch cap bead 28 over the apex 36 of container flange 34. Ideally, container neck 30 is constructed with an angle A of 90° so as to have the lower surface 40 of container flange 34 project normal to the neck 30 as shown in FIG. 2. The coactng angle on the bead 28 of the cap 16 will be 45° which permits easy manufacture or molding of this bead to produce a consistent removal torque.

Figure 3:
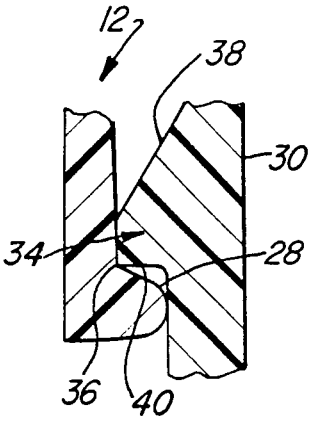
FIG. 3 is an elevational view in cross-section similar to FIG. 1 showing the threaded package having the child-resistant coacting cap bead and container flange with an additional non-backoff cap bead and coacting container non-backoff flange.

As shown in FIG. 2, a second safety feature can be added to the child-resistant closure-container package 10 in the form of a non-backoff, NBO, flange 44 on bottle neck 30 and corresponding NBO bead 46 on cap skirt 24. NBO flange 44 is located between retention flange 34 and threads 32 on container neck 30 and, correspondingly, NBO bead 46 is located between retention bead 28 and threads 26 on cap skirt 24. NBO flange 44 has a maximum diameter plane or apex 48 with an upper frusto-conical surface 50 extending upwardly and inwardly therefrom towards the neck 30 at an angle D. Angle D is from 10° to 25° from the vertical or center line of the cap and container neck to provide a gradual slope. A lower frusto-conical surface extends inwardly and downwardly from the maximum diameter plane 48 at an angle of less than 30° to the neck, shown as angle C. Typically this angle is 15° to 30° with a nominal 18 being preferred to provide a continuing slope generating a downward force to maintain cap 16 in sealing relationship to container neck 30. As the cap 16 is threaded onto container neck 30, the NBO bead 46 slides downwardly on upper frusto-conical flange surface 50 to enlarge bead 46 so that it snaps over the maximum diameter or apex 48 of NBO flange 44. Once NBO bead 46 snaps over NBO flange 44, the bead 46 will be in constant contact with lower frusto-conical surface 52 to exert a downward sealing force on cap 16 as the cap is threaded on further. Cap 16 is shown in FIG. 3 as having a flat top 54 without a dispensing orifice and having a downwardly depending flexible annular flange 56 commonly referred to as a "crab claw " which seals against the top lip 42 of container neck 30. The downward force created by this NBO connection is effective to maintain sealing of the cap with the container neck in spite of impacting caused by dropping the container or jarring which might cause partial unthreading of the cap. This constant force is effective from the point at which the NBO bead snaps over the NBO flange to a completely threaded on position. No such continuing downward force is generated by the child-resistant retention bead and cap flange.

The embodiments of the invention in which an exclusive property is claimed are defined as follows:

1. A child resistant threaded package comprising, in combination: a container having a threaded neck and an outwardly extending retention flange on said neck below said threads, said flange having an upwardly and inwardly directed surface extending from an apex into said neck and an abrupt inwardly directed lower surface, extending downwardly from said apex at an angle of 45° to 90° towards said neck; and a closure cap with an annular skirt having complementary threads for engaging said container threads and an inwardly projecting retention bead below said threads having a minimum diameter less than said container flange apex, said flange and bead being so spaced from said threads that as said cap is threaded onto said container neck, said cap retention bead is gradually expanded as it moves axially along said upper flange surface so that the smaller diameter bead snaps over the larger diameter flange apex and upon retrograde rotation of said cap in a opening direction, said bead will coact with said lower flange surface to resist removal, providing a child resistant feature requiring more force for removal than application.

2. The child resistant package of claim 1 wherein said lower flange surface extends inwardly towards said neck at approximately 90° thereto.

3. The child resistant package of claim 1 wherein said closure cap has a flat top and said container neck terminates in an annular lip and further comprising sealing means including a gasket between the top of said cap and said container lip, said gasket being compressed into sealing relationship therebetween after said cap retention bead snaps over said container flange apex by continuing rotation of said cap in a closing direction.

4. The child resistant package of claim 1 further comprising a non-backoff sealing connection between said container and cap including a non-backoff flange on said container neck located between said threads and said retention flange having an upper frusto-conical surface extending upwardly and inwardly from a maximum diameter plane towards said neck and a lower frustro conical surface extending inwardly and downwardly from said maximum diameter plane at an angle of less than 30° to said neck, and said cap skirt including an inwardly projecting non-backoff bead located between said threads and said retention bead, said non-backoff bead having a minimum diameter less than the maximum diameter of said non-backoff flange and being so spaced from said threads that as said cap is threaded onto said container, said cap non-backoff bead is gradually expanded as it moves axially along said upper frusto-conical surface so that the smaller diameter non-backoff bead snaps over the larger maximum non-backoff flange diameter and remains in contact with said lower frustro conical surface as the cap is tightened and as said cap is rotated in a retrograde opening direction to maintain said cap pulled downwardly in sealing contact with said container neck until said non-backoff bead snaps back over said maximum non-backoff flange diameter.

5. The child resistant package of claim 4 wherein said container neck terminates with a flat annular lip, and further comprising sealing means including a flexible annular flange depending downwardly from said cap to form an annular sealing fin for contact with said container lip.

6. The child resistant package of claim 4 wherein said closure cap has a flat top and said container neck terminates in an annular lip, and further comprising sealing means including a gasket between the top of said cap and said container lip, said gasket being compressed and maintained in sealing relationship therebetween upon snapping of said non-backoff bead over said maximum non-backoff flange diameter by the coaction of said non-backoff bead with said lower frusto-conical surface, maintaining said cap pulled downward on said container neck.

7. A child resistant, non-backoff threaded package, comprising, in combination: a container having a theaded neck, a non-backoff flange on said container neck below said threads, and an outwardly extending retention flange on said neck below said non-backoff flange, said non-backoff flange having an upper frusto conical surface extending upwardly and inwardly from a maximum diameter plane towards said neck and a frusto-conical surface extending inwardly and downwardly from said maximum diameter plane at an angle of less than 30° to said neck, and said retention flange having an upwardly and inwardly directed surface extending from an apex into said neck and an abrupt inwardly directed lower surface, extending downwardly from said apex at an angle of 45° to 90° towards said neck; and a closure cap with an annular skirt having complementary threads for engaging said container threads and an inwardly projecting non-backoff bead below said threads for engagement with said non-backoff container flange, and said skirt also having an inwardly projecting retention bead below said non-backoff bead; said non-backoff bead having a minimum diameter less than the maximum diameter of said non-backoff flange and being so spaced from said threads that as said cap is threaded onto said container said cap non-backoff bead is gradually expanded as it moves axially along said upper frusto-conical surface so that the smaller diameter non-backoff bead snaps over the larger maximum non-backoff flange diameter and remains in contact with said lower frusto-conical surface as the cap is tightened, said retention flange and said retention bead being so spaced from said threads that as said cap is threaded onto said container neck, said retention bead is gradually expanded as it moves axially along said upper flange surface so that the smaller diamter beads snaps over the larger diameter flange apex, and upon retrograde rotation of said cap in a removal direction, said retention bead will coact with said lower flange surface to resist removal providing a child resistant feature requiring more force for removal than application, and said non-backoff bead will coact with said lower frusto-conical surface to maintain said cap pulled downwardly in sealing contact with said container neck until said non-backoff bead snaps over said maximum non-backoff flange diameter.

* * * * *